US009263176B2

(12) United States Patent
Kim et al.

(10) Patent No.: US 9,263,176 B2
(45) Date of Patent: Feb. 16, 2016

(54) CONDUCTOR PATTERN AND ELECTRONIC COMPONENT HAVING THE SAME

(75) Inventors: Yong Suk Kim, Gyeonggi-do (KR); Sung Kwon Wi, Seoul (KR); Sang Moon Lee, Seoul (KR); Young Seuck Yoo, Seoul (KR); Jeong Bok Kwak, Gyeonggi-do (KR)

(73) Assignee: SAMSUNG ELECTRO-MECHANICS CO., LTD., Suwon-Si, Gyeonggi-Do (KR)

( * ) Notice: Subject to any disclaimer, the term of this patent is extended or adjusted under 35 U.S.C. 154(b) by 0 days.

(21) Appl. No.: 13/596,606

(22) Filed: Aug. 28, 2012

(65) Prior Publication Data

US 2013/0049917 A1 Feb. 28, 2013

(30) Foreign Application Priority Data

Aug. 29, 2011 (KR) ..... 10-2011-0086532

(51) Int. Cl.

| | |
|---|---|
| ***H01F 5/00*** | (2006.01) |
| ***H01F 27/28*** | (2006.01) |
| ***H01F 17/00*** | (2006.01) |
| ***H01F 41/04*** | (2006.01) |

(52) U.S. Cl.

CPC ..... *H01F 17/0006* (2013.01); *H01F 41/041* (2013.01); *H01F 2017/0066* (2013.01); *H01F 2017/0073* (2013.01)

(58) Field of Classification Search

CPC ..... H01F 2017/0073
USPC ..... 336/200, 223, 232, 225
See application file for complete search history.

(56) References Cited

U.S. PATENT DOCUMENTS

| | | | | |
|---|---|---|---|---|
| 2005/0195063 | A1* | 9/2005 | Mattsson | 336/225 |
| 2007/0063805 | A1* | 3/2007 | Poynton | 336/200 |
| 2009/0184794 | A1* | 7/2009 | Tsuzuki | 336/200 |
| 2010/0141370 | A1* | 6/2010 | Lu et al. | 336/200 |

FOREIGN PATENT DOCUMENTS

| | | | |
|---|---|---|---|
| JP | 10-203066 | A | 8/1998 |
| JP | 2006-261585 | A | 9/2006 |
| JP | 2008-028241 | A | 2/2008 |

(Continued)

OTHER PUBLICATIONS

Japanese Office Action issued in Japanese Application No. 2012-187279 issue date Apr. 1, 2014.

(Continued)

*Primary Examiner* — Elvin G Enad
*Assistant Examiner* — Ronald Hinson
(74) *Attorney, Agent, or Firm* — McDermott Will & Emery LLP

(57) ABSTRACT

Disclosed herein are a conductor pattern of an electronic component formed in an oval coil shape on a magnetic substrate, the conductor pattern including: a straight part; and a curved part connected to the straight part at both sides thereof, wherein a line width of the curved part is smaller than that of the straight part, and an electronic component including the same. With the conductor pattern and the electronic component including the same according to the present invention, the high precision fine line width and the high resolution conductor pattern may be implemented to improve connectivity, thereby improving characteristics and reliability of the electronic component.

2 Claims, 5 Drawing Sheets

(56) References Cited

FOREIGN PATENT DOCUMENTS

| | | | |
|---|---|---|---|
| JP | 2010-153416 | A | 7/2010 |
| KR | 1020020007220 | A | 1/2002 |
| KR | 10-2006-0130711 | A | 12/2006 |

OTHER PUBLICATIONS

Korean Office Action issued in Korean Application No. 10-2011-0086532 dated Aug. 7, 2014.

* cited by examiner

- PRIOR ART -

- PRIOR ART -

- PRIOR ART -

CONDUCTOR PATTERN AND ELECTRONIC COMPONENT HAVING THE SAME

CROSS REFERENCE(S) TO RELATED APPLICATIONS

This application claims the benefit under 35 U.S.C. Section 119 of Korean Patent Application Serial No. 10-2011-0086532, entitled "Conductor Pattern and Electronic Component Having the Same" filed on Aug. 29, 2011, which is hereby incorporated by reference in its entirety into this application.

BACKGROUND OF THE INVENTION

1. Technical Field

The present invention relates to a conductor pattern and an electronic component having the same, and more particularly to a conductor pattern capable of implementing a conductor pattern having a high precision fine line width and a high resolution to improve connectivity, thereby improving characteristics and reliability of an electronic component, and an electronic component having the same.

2. Description of the Related Art

In an electronic component such as a digital TV, a smart phone, a laptop computer, or the like, a transmission/reception function of data in a high frequency band has been widely used. In future, it is expected that this information technology (IT) electronic product is singly used or several IT electronic products are connected to each other using a universal serial bus (USB), other communication ports so as to be multi-functionalized and complexed, such that the utilization of the IT electronic product will increase.

Here, in order to rapidly transmit and receive the data, a frequency band is moved from a frequency band such as a MHz band to a high frequency band such as a GHz band, such that a large amount of data are transmitted and received through internal signal lines.

In order to transmit and receive a large amount of data as described above, there is a problem in smoothly processing the data due to signal delay and other noises at the time of transmission and reception of the data of the high frequency band such as the GHz band between a main device and a peripheral device.

In order to solve the problem, a counter electromagnetic interference (EMI) component is provided around a connection portion between the IT electronic product and a peripheral device. However, the existing counter EMI component, which is a winding or multilayered type, has a large chip component and bad electrical characteristics, such that it may be used only in a limited region such as a specific portion, a large area circuit board, and the like. Therefore, in accordance with slimness, miniaturization, complexities, multi-functionalization of the electronic products, counter EMI components have been demanded.

The existing winding or multilayered type counter EMI components have a limitation in forming an internal circuit having a small area required for adding various functions in order to correspond to formation and miniaturization of an internal conductor pattern and causes many problems.

More specifically, in the existing winding or multilayered type counter EMI components, in order to form a fine line width of the internal conductor pattern and connect an upper pattern and a lower pattern that are laminated to each other, a via is formed and electrical conduction is then made to form a plurality of internal patterns, that is, coil type patterns, in a limited area, such that direct current (DC) bias characteristics are decreased due to an increase in a change rate in inductance according to impedance, DC resistance, and high current, internal resistance increases due to distortion or disconnection of the pattern caused by irregularity of a thickness between the layers, and the impedance and a coupling coefficient are decreased due to a defect in an alignment state of the upper and lower internal conductor patterns.

In other words, the internal conductor pattern is formed by a photolithography process. Here, in the case of directly forming the internal conductor pattern on a magnetic material substrate and a polymer resin insulating layer or the magnetic material substrate, various problems have been generated at the time of performing deposition, exposure, development, plating, and etching processes.

In particular, in the case of removing unnecessary metal patterns in order to implement a fine line width of the internal conductor pattern at the time of performing the etching process, an interval between the patterns adjacent to each other is narrow, such that it is difficult to perform penetration of an etching liquid and delamination, thereby causing problems such as collapse of the patterns, local removal of an actual pattern due to over-etching, and the like. In addition, product reliability is decreased due to a decrease in adhesion between the internal conductor pattern and the substrate caused by under-cut.

That is, as shown in FIG. 1A, a phenomenon that an outside portion of the internal conductor pattern 1 is collapsed has been generated, which causes an increase in the DC resistance and a decrease in a coupling coefficient due to the defect in the alignment state between the upper and lower internal conductor patterns that are main characteristics of the EMI electronic components.

Alternatively, as shown in FIG. 1B, a separation or delamination phenomenon between the substrate and the patterns due to the over-etching has been generated after an etching process for forming the internal conductor pattern to decrease the adhesion between the substrate and the internal conductor pattern 2, thereby decreasing the product reliability.

In addition, as shown in FIG. 1C, the thickness of the internal conductor pattern 3 is non-uniform to decrease the adhesion between the substrate and the internal conductor pattern and cause distortion of the pattern due to a step generated at the time of forming a plurality of layers.

As an example, FIG. 2 is a view showing the internal conductor pattern of a common mode filter of the existing EMI electronic components. Referring to FIG. 2, the internal conductor pattern 11 of the existing common mode filter 10 has a helical coil shape in general, and a line width W of the internal conductor pattern 11 is uniformly formed.

In a method of fabricating the internal conductor pattern 11, a conductive substrate 12 is firstly prepared, and a seed layer such as Ti, Cr, Cu, Ag, or the like is formed for forming the internal conductor pattern 11 on the conductive substrate 12. In addition, after applying a photoresist on the seed layer, exposure, development, etching, and photoresist removing processes may be performed to form the internal conductor patterns. Here, a process of laminating a dry film instead of the photoresist may be performed.

However, in the internal conductor pattern 11 of the existing common mode filter 10, the line width W is uniformly formed, such that an interval between the conductor patterns is narrow. Therefore, a treating liquid is not smoothly penetrated or removed at the time of performing the exposure, the development, and the etching processes to decrease implementation of the internal conductor patterns.

In particular, as shown in FIG. 3, in the case of a portion which is curved of the internal conductor pattern 11, that is an oval coil pattern, the treating liquid is not smoothly penetrated and removed in a curved part 11*b* as compared to a straight part 11*a*. Therefore, a Cu seed layer 13 is not removed, such that the conductor patterns are not electrically separated from each other, but are connected to each other, that is, short-circuited.

SUMMARY OF THE INVENTION

An object of the present invention is to provide a conductor pattern capable of implementing a conductor pattern having a high-precision fine line width and a high resolution to improve connectivity, thereby improving characteristics and reliability of an electronic component, and an electronic component having the same.

According to an exemplary embodiment of the present invention, there is provided a conductor pattern of an electronic component formed in an oval coil shape on a magnetic substrate, the conductor pattern including: a straight part; and a curved part connected to the straight part at both sides thereof, wherein a line width of the curved part is smaller than that of the straight part.

In the case in which the line width of the straight part is 10 μm, the line width of the curved part may be 8 to 9 μm.

In the case in which an interval between the straight parts adjacent to each other is 10 μm, an interval between the curved parts adjacent to each other may be 10 to 12 μm.

The conductor pattern may further include an internal coil pattern of a common mode filter.

According to another exemplary embodiment of the present invention, there is provided an electronic component including: a magnetic substrate; a first conductor pattern formed on the magnetic substrate; and a second conductor pattern provided on an upper portion of the first conductor pattern, wherein the first conductor pattern and the second conductor pattern are formed in an over coil shape in which they include a straight part, and a curved part connected to straight part at both sides thereof, a line width of the curved part being smaller than that of the straight part.

DESCRIPTION OF THE PREFERRED EMBODIMENTS

Figure 1A:
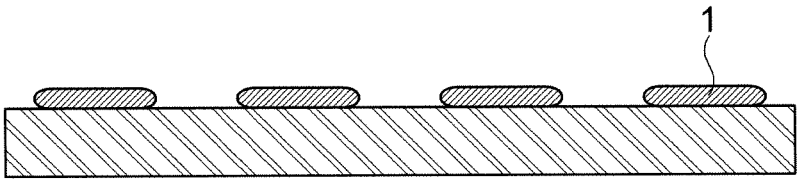
FIG. 1 is a view describing problems at the time of forming the existing internal conductor pattern, wherein (a) is a view showing collapse of an outside pattern, (b) is a view showing separation of the outside pattern, and (c) is a view showing a change in a shape of an upper portion of the pattern.
Figure 1B:
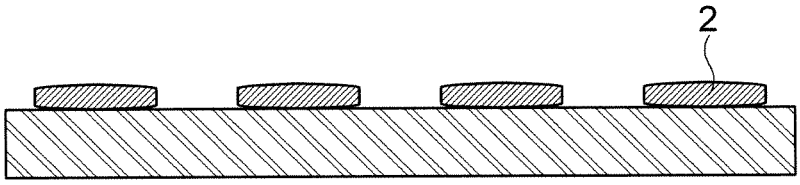
Figure 1C:
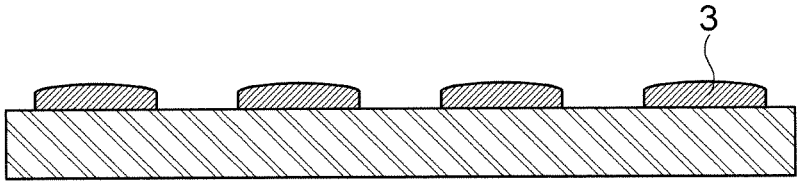
Figure 2:
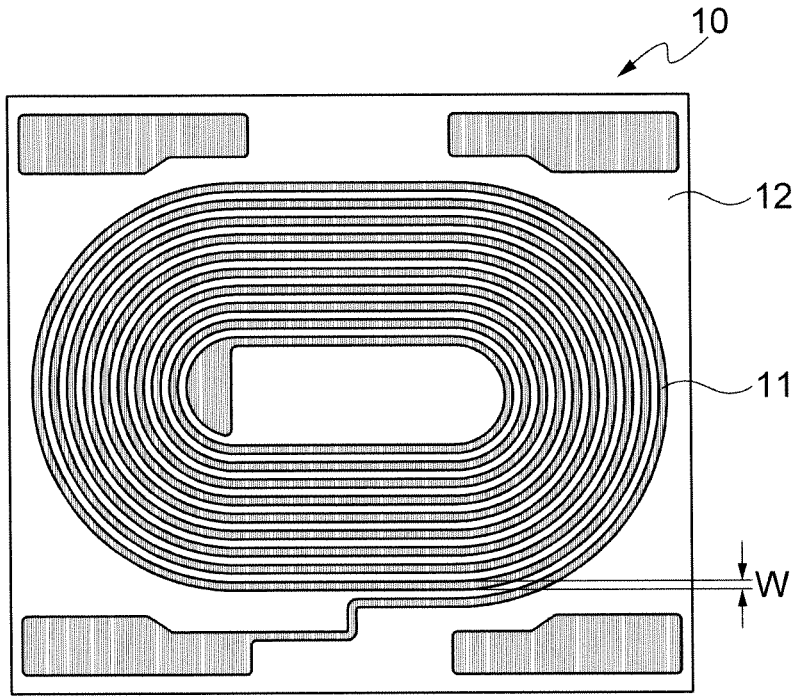
FIG. 2 is a transverse cross-sectional view schematically showing the existing common mode filter.
Figure 3:
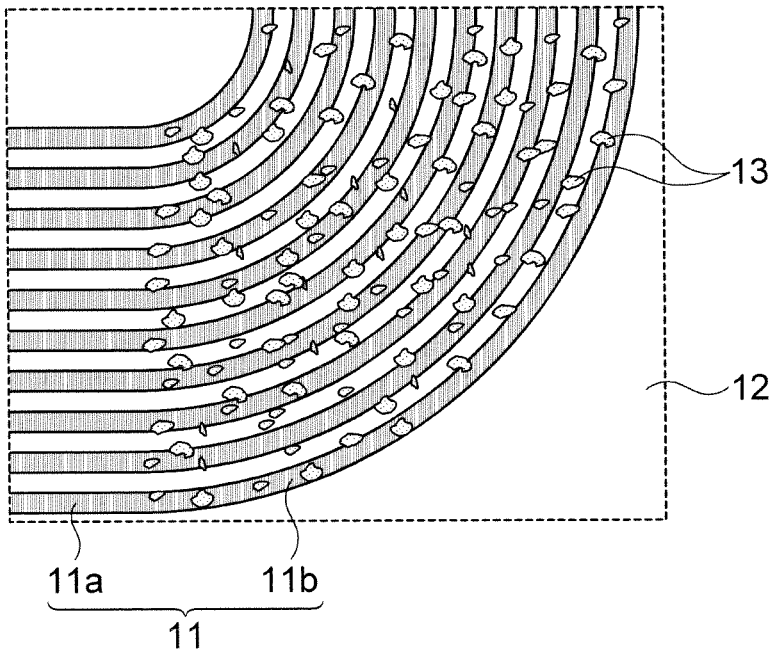
FIG. 3 is an enlarged view of a major part schematically showing the internal conductor pattern of the existing common mode filter.

Hereinafter, exemplary embodiments of the present invention in which objects of the present invention may be specifically implemented will be described with reference to the accompanying drawings. In the exemplary embodiments of the present invention, the same terms and reference numerals will be used to describe the same components. Therefore, an additional description for the same component will be omitted below.

Hereinafter, an exemplary embodiment of a common mode filter according to the present invention will be described in detail with reference to FIGS. 4 to 6.

Figure 4:
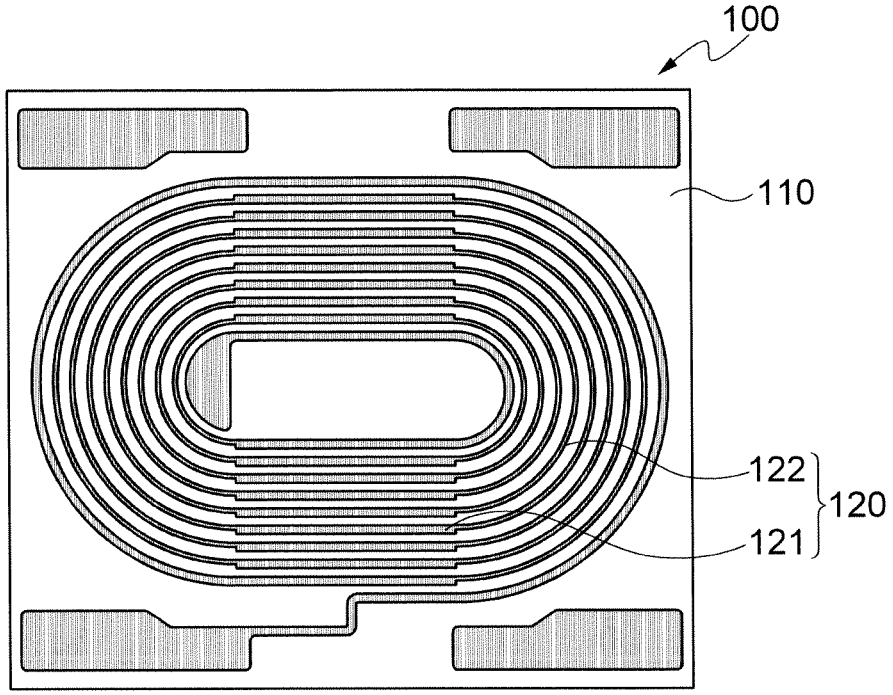
FIG. 4 is a transverse cross-sectional view schematically showing a common mode filter according to the present invention.
Figure 5:
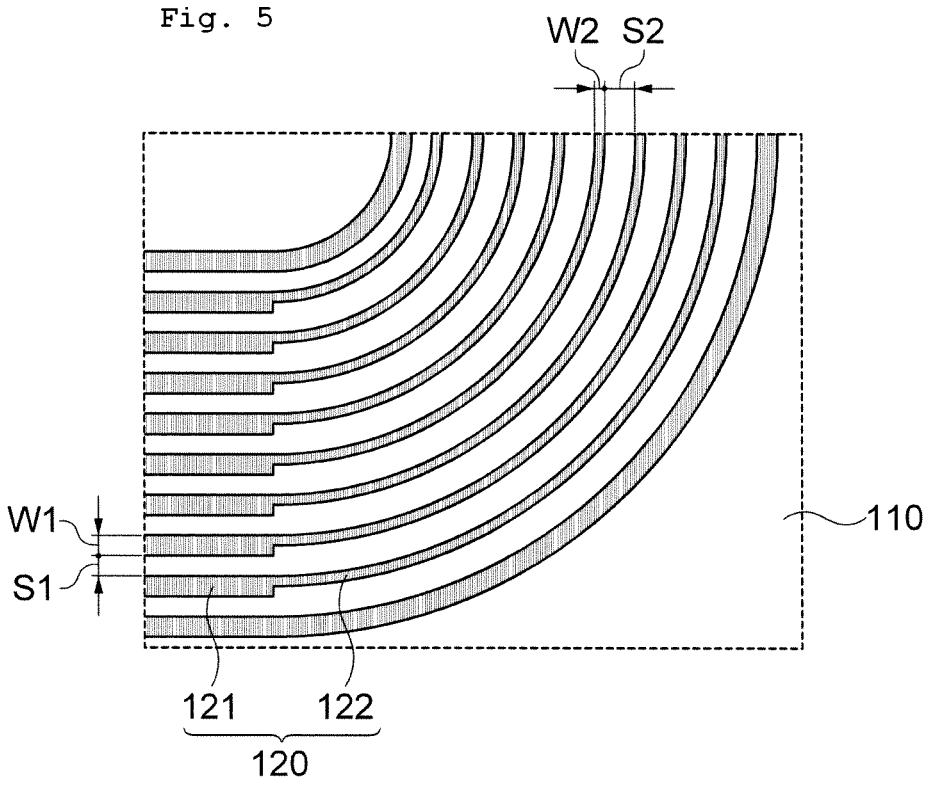
FIG. 5 is an enlarged view of a major part schematically showing the internal conductor pattern of the common mode filter according to the present invention.
Figure 6:
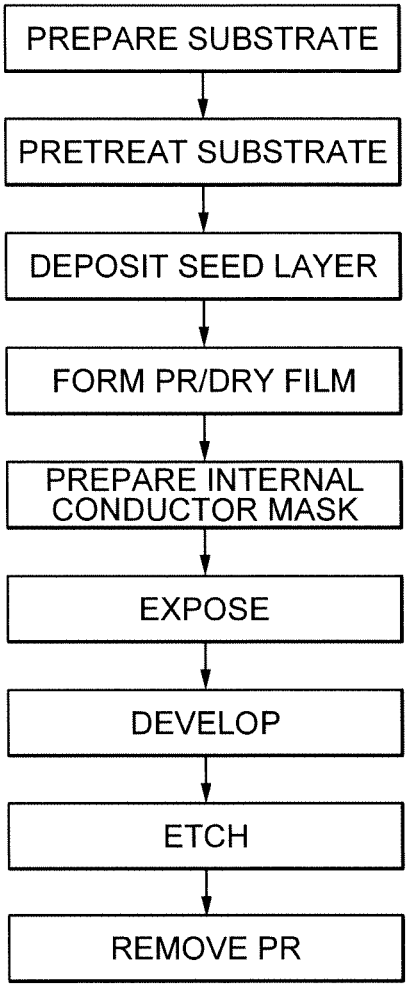
FIG. 6 is a block diagram schematically showing a process of manufacturing the common mode filter according to the present invention.

FIG. 4 is a transverse cross-sectional view schematically showing a common mode filter according to the present invention, FIG. 5 is an enlarged view of a major part schematically showing the internal conductor pattern of the common mode filter according to the present invention, and FIG. 6 is a block diagram schematically showing a process of manufacturing the common mode filter according to the present invention.

Referring to FIG. 4, the common mode filter 100 as an exemplary embodiment of an electronic component according to the present invention may be mainly configured to include a magnetic substrate 110, and an internal conductor pattern 120 formed on the magnetic substrate 110.

In addition, although not shown in detail, the common mode filter 100 according to the exemplary embodiment of the present invention may include the internal conductor pattern 120 formed as a primary coil on the magnetic substrate 110, and a secondary coil formed in a shape corresponding to that of the internal conductor pattern 120 via an insulating layer on an upper portion of the internal conductor pattern 120, and a magnetic material or a magnetic substrate formed in a shape corresponding to that of the magnetic substrate 110 on an upper portion of the secondary coil.

Meanwhile, the internal conductor pattern 120, which is a conductor pattern of the common mode filter 100 formed in a coil shape on the magnetic substrate 110, may be mainly formed in an oval shape to include a straight part 121 and a curved part 122 connected to the straight part 121 at both sides thereof.

Here, referring to FIG. 5, in the exemplary embodiments of the present invention, a line width W2 of the curved part 122 may be smaller than a line width W1 of the straight part 121

Therefore, an interval S2 between the curved parts 122 adjacent to each other may be larger than an interval S1 between the straight parts 121 adjacent to each other.

As an example, in the case in which the line width W1 of the straight part 121 is 10 μm, the line width W2 of the straight part 122 may be formed to be 8 to 9 μm.

In addition, in the case in which the interval S1 between the straight part 121 adjacent to each other is 10 μm, the interval S2 between the curved part 122 adjacent to each other may be formed to be 10 to 12 μm.

Therefore, in the common mode filter 100 including the internal conductor pattern 120 according to the exemplary embodiment of the present invention, in the case of forming the internal conductor pattern 120 on the magnetic substrate 110 by a photolithography process, the line width W1 of the straight part 121 and the line width W2 of the curved part 122 in the internal conductor pattern 120 are formed to be different and the interval S1 between the straight parts 121 and the interval S2 between the curved parts 122 are formed to be different, such that a treating liquid is smoothly penetrated or removed at the time of performing exposure, development, and the etching processes to increase implementation of the internal conductor pattern.

That is, in the internal conductor pattern 120 according to the exemplary embodiment of the present invention, the line width W2 of the curbed part 122 is formed to be smaller than the line width W1 of the straight part 121 and the interval S2 between the curbed parts 122 is formed to be larger than the interval S1 between the straight parts 121, such that the treating liquid is smoothly penetrated or removed at the time of performing the photolithography process for forming the curved part 122 to implement a high-precision fine pattern and a high resolution conductor pattern. Therefore, connection and precision of the internal conductor pattern may be improved to thereby improve characteristics of the common mode filter 100 and product reliability.

A method of manufacturing a common mode filter according to an exemplary embodiment of the present invention configured as above will be described below.

Referring to FIG. 6, in the method of manufacturing the common mode filter according to the exemplary embodiment of the present invention, after the magnetic substrate is formed, a pretreatment process removing pollution materials such as dust of the magnetic substrate, a treatment solution, and the like may be performed.

In addition, a seed layer for plating, which is made of Ti, Cr, Cu, Ag, and the like, may be formed on the magnetic substrate for plating on an upper portion of the magnetic substrate. Here, the insulating layer may be formed on the magnetic substrate, and may be formed by mixing at least one low-K dielectric polymer material such as low-K ceramic or parylene, polyimide, liquid crystal polymer (LCP), or Teflon with each other.

Meanwhile, the seed layer may be formed by using sputtering, e-beam, or the like. Preferably, the seed layer may be formed by a cold spray method under the atmosphere of argon (Ar), helium (He), nitrogen dioxide ($N_2$) in high pressure, such that particles of the surface of the magnetic substrate and metal particles of the seed layer may be uniformly formed without the voids.

Thereafter, a photoresist or a dry film is coated or compressed on the seed layer, and the exposure, the development, the etching, the photoresist removing processes, and the like, are then performed on the seed layer using a photo mask having a shape corresponding to the internal conductor pattern of which the line width and the interval of the straight part are different from those of the curved part, thereby making it possible to form the internal conductor pattern according to the exemplary embodiment of the present invention of which the line width and the interval of the straight part are different from those of the curved part.

In the case of performing the exposure, the development, the etching, the photoresist removing processes, and the like, in the related art, it is not easy for the treatment solutions to penetrate between the internal conductor patterns and be removed. However, in the exemplary embodiment of the present invention, the line width of the straight part is different from that of the curved part, that is, the line width of the curved part is smaller than that of the straight part, and the interval between the curved parts is larger than that between the straight parts, such that at the time of forming the internal conductor pattern of the curved part, the treatment solution is easily penetrated and removed, thereby making it possible to implement the high precision fine pattern and the high resolution conductor pattern.

Therefore, the common mode filter including the high-precision and high resolution internal conductor pattern as described above may increase impedance and a coupling coefficient in a high frequency band and improve the characteristics of the filter, such as an low DC resistance, and the like, and the product reliability.

As set forth above, with the conductor pattern and the electronic component including the same according to the present invention, the high precision fine line width and the high resolution conductor pattern may be implemented to improve connectivity, thereby improving characteristics and reliability of the electronic component.

Although the preferred embodiments of the present invention have been disclosed for illustrative purposes, those skilled in the art will appreciate that various modifications, additions and substitutions are possible, without departing from the scope and spirit of the invention as disclosed in the accompanying claims. Accordingly, such modifications, additions and substitutions should also be understood to fall within the scope of the present invention.

What is claimed is:

1. A conductor pattern of an electronic component formed in an oval coil shape on a magnetic substrate, the conductor pattern comprising:

a straight part; and a curved part connected to the straight part at both sides thereof, wherein a line width of all the curved part is smaller than that of the straight part, a space between the conductor pattern of the curved part is wider than a space between the conductor pattern of the straight part, and a sum of the line width of the curved part and the space between the conductor patterns of the curved part is equal to a sum of the line width of the straight part and the space between the conductor patterns of the straight part.

2. The conductor pattern according to claim 1, further comprising an internal coil pattern of a common mode filter.

* * * * *